United States Patent [19]
Winkless et al.
[11] Patent Number: 4,496,069
[45] Date of Patent: Jan. 29, 1985

[54] CLOSURE BREAK-AWAY TABS

[75] Inventors: Robert A. Winkless, Oak Lawn; Edmund M. Kulesa, South Holland, both of Ill.

[73] Assignee: Continental Can Company, Inc., Stamford, Conn.

[21] Appl. No.: 554,856

[22] Filed: Nov. 23, 1983

[51] Int. Cl.[3] ..... B65D 51/16; B65D 39/00
[52] U.S. Cl. ..... 220/260; 220/307; 220/270; 220/339
[58] Field of Search ..... 220/260, 307, 375, 339, 220/270, 284; 222/543, 565, 569, 566

[56] References Cited

U.S. PATENT DOCUMENTS 4,328,906 5/1982 Walter ..... 220/260
4,407,423 10/1983 Walter ..... 220/260

*Primary Examiner*—George T. Hall
*Attorney, Agent, or Firm*—Charles E. Brown

[57] ABSTRACT

This relates to the modification of an existing type of closure which employs a fulcrum post about which a part of the closure functioning as a lever pivots while bearing on an axially facing surface of the fulcrum post so as to weaken the fulcrum post in a manner wherein, when a pry tool is used and bears against the fulcrum post in a radial direction, the fulcrum post will separate into bendable tabs both to hinder the prying operation and to give indication of tampering efforts.

5 Claims, 5 Drawing Figures

CLOSURE BREAK-AWAY TABS

This invention relates in general to new and useful improvements in closures, and more particularly to a closure of the type specifically illustrated and described in U.S. Pat. No. 4,328,906, granted to John Walter on May 11, 1982.

This invention particularly relates to a closure which is formed of three pieces hingedly connected together and includes a neck member which defines a pour opening, a closure plug portion which is hingedly connected to the neck member and has a pour opening plug for closing the pour opening. The closure plug portion also has a vent opening therein and there is a venting portion hingedly connected to the closure plug portion and having a vent plug for closing the vent opening. The venting portion, when manipulated in an opening action, withdraws the vent plug and hinges relative to the closure plug portion to function as a lever against a fulcrum post carried by the neck member so as to pry the closure plug portion away from the neck member and to initiate movement of the pour opening plug out of the pour opening.

In the assembled form of the closure, the hinge between the closure plug portion and the venting portion is disposed generally radially inwardly of and adjacent the fulcrum post. Further, the venting portion has a tamper-indicating connection between it and the closure plug portion. Thus, attempts have been made to open the closure without rupturing the tamper-indicating connection by placing suitable pry tools between the fulcrum post and the aforementioned hinge and utilizing the fulcrum post as a pivot in a radial direction urging the venting portion and the closure plug portion axially away from the neck member as a unit to open the closure.

In accordance with this invention, it is proposed to provide weakening means in the fulcrum post which generally divide the fulcrum post into at least two bendable tabs so as to prevent the use of the fulcrum post as a radial fulcrum while not inhibiting the use of the fulcrum post as an axial fulcrum.

In a preferred embodiment of the closure, the neck member has an upstanding collar and the fulcrum post is a chordal member. Further, the fulcrum post may be axially recessed relative to the collar. With this type of closure construction, the slit or weakening line in the fulcrum post will extend radially outwardly into the collar, but will not extend entirely through the collar so as to function as tamper-indicating means should a pry tool be used which results in the rupture of the collar as the bendable tabs bend radially outwardly.

When the closure is provided with a collar, the neck member will also have radial slits in the collar at the opposite ends of the fulcrum post, with these slits also extending radially outwardly and terminating within the collar to provide further tamper-indicating means.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
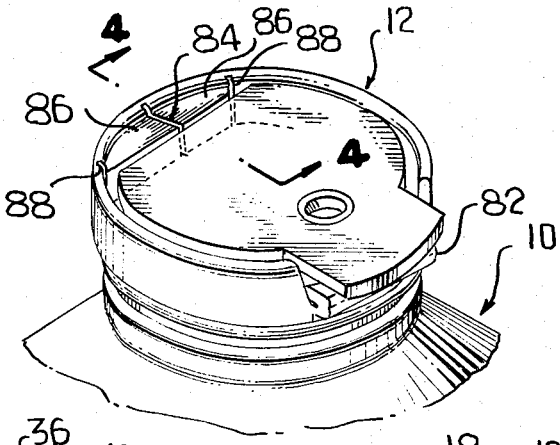
FIG. 1 is a fragmentary top perspective view of a closure in accordance with the invention applied to a container.
Figure 2:
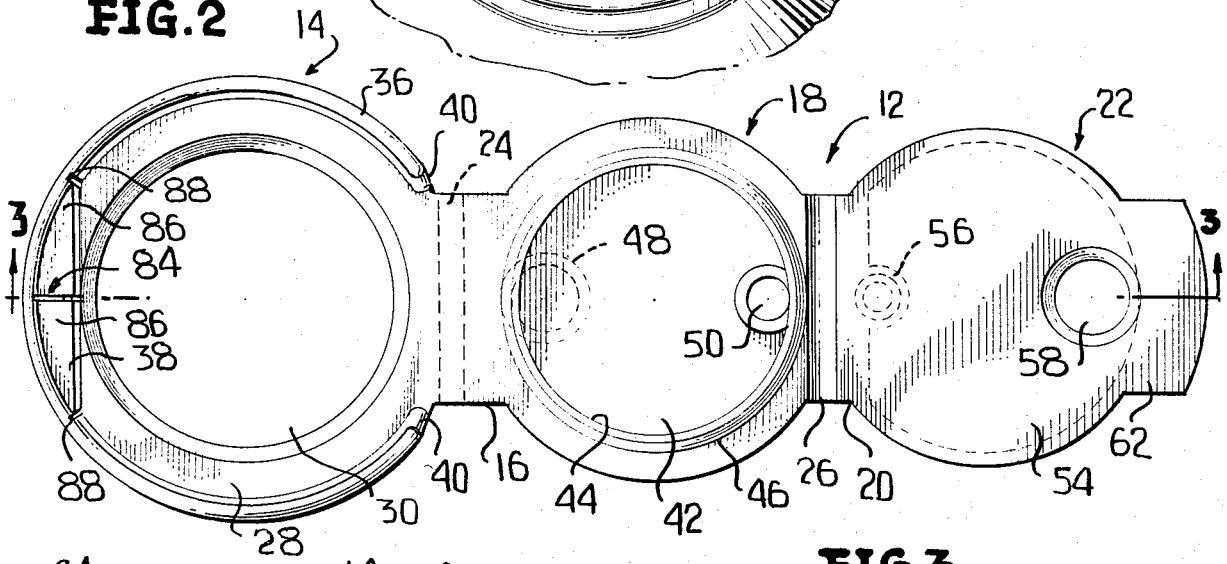
FIG. 2 is a plan view of the closure per se.
Figure 3:
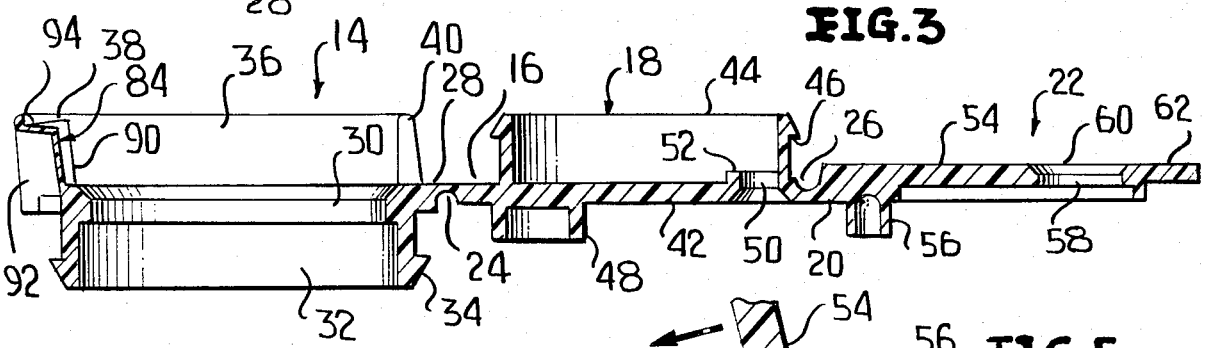
FIG. 3 is a longitudinal vertical sectional view taken generally along the line 3—3 of FIG. 2, and shows generally the details of the closure.

Referring now to the drawings in detail, it will be seen that there is illustrated in FIG. 1 an upper portion of a container which is generally identified by the numeral 10. The container 10 is provided with a closure 12 which is formed in accordance with this invention. The closure 12 is formed of a plastic material and is molded in a flat state as shown in FIGS. 2 and 3. The closure 12 includes a neck member 14 which is connected by a strap portion 16 to a closure plug portion 18. The closure plug portion 18 is, in turn, connected by means of a strap portion 20 to a venting portion generally identified by the numeral 22. The strap portion 16 may be provided on the underside thereof with a weakening line 24 as is clearly shown in FIG. 3. In a like manner, the strap portion 20 is provided on the upper surface thereof with a weakening line 26 to define a hinge.

The neck member 14, as is best shown in FIG. 3, is of a generally tubular construction and includes an annular body member 28 defining a pour opening 30. The body member has depending therefrom a tubular skirt 32 which is provided on the outer surface thereof with a retaining hook 34.

The neck member 14 also includes an upstanding collar 36. A fulcrum post 38 extends chordally across the interior of the collar 36 diametrically opposite to the strap portion 16. It is to be noted that the fulcrum post 38 is of a slightly lesser height than the collar 36 and thus is axially recessed therein.

At this time it is also to be noted that the collar 36 is interrupted in alignment with the strap portion 16 and has generally circumferentially facing ends 40.

The closure plug portion 18 includes a body member 42 which has projecting axially upwardly therefrom a plug member 44 which is annular and which is provided on the outer surface thereof with a locking rib 46.

The closure plug portion 18 has extending axially from the underside of the body member 42 a tubular member 48 which will be described in detail hereinafter.

There is a vent opening 50 through the body member 42 with the vent opening 50 being in part defined by a projection 52 formed on the upper surface of the body member 42 adjacent that part of the closure plug 44 which is adjacent the strap portion 20. The underside of the body member 42 in alignment with the vent opening is flared so as to facilitate the insertion of a vent plug to be described hereinafter.

The venting portion 22 also includes a body member 54 which is slightly axially offset from the body members 28 and 42. The body member 54 has depending from the underside thereof a vent plug 56 which may be tubular and which is of a size to be received in the vent opening 50 to close the vent opening. The body member 54 remote from the strap portion 20 is also provided with an opening 58 of a size to receive the plug 48. It is to be noted that the opening 58 on the upper surface of the body member 54 is flared as at 60.

The venting portion 22 includes a projection from the body member 54 in the form of a lift tab 62 which is disposed remote from the strap portion 20.

Figure 4:
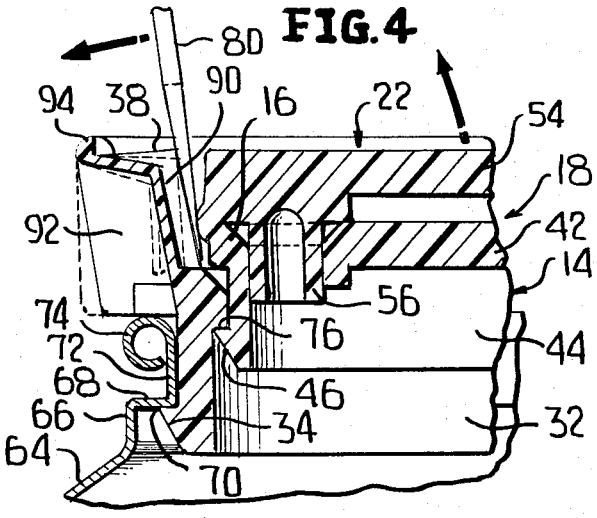
FIG. 4 is a fragmentary sectional view taken generally along the line 4—4 of FIG. 1, and shows the manner in which a pry tool may be used.

Referring now to FIG. 4, it will be seen that the container 10 may include a tubular neck portion generally identified by the numeral 64, which neck portion includes a lower cylindrical part 66 which terminates in a radially inwardly directed flange 68 which defines an axially inwardly facing shoulder 70. The neck portion 68 includes another cylindrical portion 72 which extends axially upwardly from the radially inner edge of the flange 68 and terminates in a radially outwardly directed curl 74.

It will be seen that when the closure 12 is applied to the container 10, the skirt portion 32 has a force fit within the neck portion 64 and the retaining hook 34 locks beneath the shoulder 70 to retain the neck member 14 within the neck portion 64 in sealed relation therewith.

It will also be seen that the pour opening 30 being of a lesser diameter than the internal diameter of the skirt 32 results in the body member 28 forming on the underside thereof surround the pour opening 30 a shoulder 76. When the plug member 44 is inserted into the pour opening 30 for the purpose of closing the same, the locking rib 46 engates behind the shoulder 76 releasably to lock the plug member 44 in place.

The venting portion 22, when folded into its closed position, has the vent plug 56 received in the vent opening 50 for closing the same. At the same time, the tubular post 48 passes through the opening 58 and is suitably flared so as to seat in the flared area 60 so as to lock the venting portion 22 relative to the closure plug portion 18 in a tamper-indicating manner.

Figure 5:
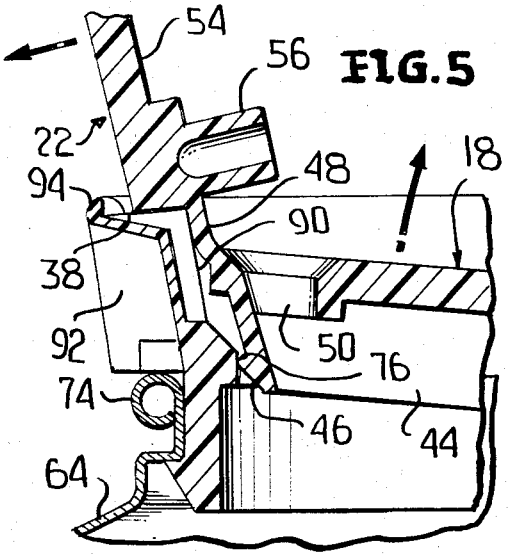
FIG. 5 is a fragmentary sectional view similar to FIG. 4, but with the lever formed by the venting member in its released position and functioning as a pry member.

Referring now to FIG. 5, it will be seen that in the normal opening of the closure 12 the venting portion 22 is lifted by the lift tab 62 so as to break the connection between the venting portion 22 and the closure plug portion 18 formed by the tubular post 48, thereby giving evidence of tampering or opening. The venting portion 22, when pivoted to the position shown in FIG. 5, functions as a lever by engaging the fulcrum post 38 on the top thereof in an axial direction only so as to lift the plug 44 at least initially out of the pour opening 30.

Referring now to FIG. 4, it will be seen that the hinge formed by the strap portion 16 and generally identified by the numeral 78 is disposed immediately adjacent the fulcrum post 38 and radially within the same. Attempts have been made to insert a suitable pry tool, such as the illustrated screwdriver 80 into the base between the fulcrum post 38 and the hinge 78 with the pry member acting radially on the fulcrum post 38 and against the hinge 78 to pry the venting portion 22 and the closure plug portion 18, as a unit, upwardly so as to remove the plug 44 from the pour opening 30 without evidence of tampering. The net result would be the pivoting of the venting portion 22 and the closure plug portion 18 by way of a hinge 82 formed by the strap portion 20 along the weakening line 26.

In accordance with this invention, the fulcrum post 38 is modified so as to give evidence of the use of a pry tool and in part preventing the effective use of such a pry tool without harming its function as a fulcrum post for the venting portion 22 as shown in FIG. 5. Most specifically, in accordance with this invention there is provided a radial slit 84 in the central part of the fulcrum post 38 which may extend the full height of the fulcrum post as shown in FIG. 3. The radial slit 84 also opens into the collar 36 from the inner surface thereof, but does not extend through the collar 36. The slit 84 effectively divides the fulcrum post 38 into two tabs 86 which are bendable relative to the body member 28 when the pry tool is applied in the manner shown in FIG. 4. When the bendable tabs 86 do bend, they prevent the pry tool 80 from functioning. Further, that portion of the collar 36 which has not been ruptured by way of the slit 84, ruptures under the force of the pry tool to give evidence of tampering.

Further, there may be additional slits 88 in the inner surface of the collar 36 at the ends of the fulcrum post 38. This will permit the collar 36 further to rupture and thus permit the bendable tabs to bend under the influence of the pry tool.

At this point, with particular reference to FIG. 3, it will be seen that the slit 84 may be of a two-part construction and it may include an inner slit portion 90 and an outer slit portion 92.

There will also be an inner slit portion 94 in the collar 36.

It is to be understood that the configuration of the slit 84 and the general arrangement of the slits 84 and 88 may be varied depending upon the force desired to effect operation of the tabs 86 and the bending thereof relative to the body member 28.

Although only a preferred embodiment of the weakening of the fulcrum post has been specifically illustrated and described herein and the weakening of the fulcrum post has been disclosed only with respect to a preferred embodiment of closure, it is to be understood that minor variations may be made in the closure and weaking of the fulcrum thereof without departing from the spirit and scope of the invention as defined by the appended claims.

We claim:

1. A closure for a container comprising a tubular neck member having a pour opening, a closure plug portion hingedly connected to said neck member by a first hinge and having a pour opening plug for closing said pour opening and a vent opening, and a venting portion hingedly connected to said closure plug portion by a second hinge and having a vent plug for closing said vent opening, said neck member having adjacent said pour opening an upstanding fulcrum post and said venting portion including a lever engageable with said fulcrum post to lift one end of said closure plug portion relative to said neck member and to initiate removal of said pour opening plug from said pour opening, said closure in its closed condition having said second hinge disposed adjacent said fulcrum post wherein a pry tool may be used to pry said closure plug portion relative to said neck member in a tampering action, said fulcrum post having weakening means formed therein for effecting distortion thereof by a pry tool to provide tamper-indicating means.

2. A closure in accordance with claim 1 wherein said fulcrum post is a chordal member and said weakening means includes at least one radial slit in said fulcrum post dividing said fulcrum post into separate parts.

3. A closure in accordance with claim 1 wherein said neck member has an upstanding collar, said fulcrum post is a chordal member within said collar, and said weakening means includes at least one radial slit extending generally across said fulcrum post and terminating in said collar, said radial slit dividing said fulcrum post into two parts.

4. A closure according to claim 3 wherein said collar is also weakened at opposite ends of said fulcrum post.

5. A closure according to claim 3 wherein said collar is also weakened at opposite ends of said fulcrum post by a radial slit starting at a radially inner surface of said collar and terminating in said collar.

* * * * *